US011808052B1

(12) United States Patent
Johnson

(10) Patent No.: US 11,808,052 B1
(45) Date of Patent: Nov. 7, 2023

(54) PANEL STRUCTURE WITH SLOTTED MOUNTING SYSTEM

(71) Applicant: WireCrafters, LLC, Louisville, KY (US)

(72) Inventor: Erik Johnson, Bardstown, KY (US)

(73) Assignee: WireCrafters, LLC, Louisville, KY (US)

( * ) Notice: Subject to any disclaimer, the term of this patent is extended or adjusted under 35 U.S.C. 154(b) by 252 days.

(21) Appl. No.: 17/220,329

(22) Filed: Apr. 1, 2021

Related U.S. Application Data

(60) Provisional application No. 63/018,053, filed on Apr. 30, 2020.

(51) Int. Cl.
*E04H 17/16* (2006.01)

(52) U.S. Cl.
CPC ..... *E04H 17/163* (2013.01)

(58) Field of Classification Search
CPC ... E04H 17/1452; E04H 17/16; E04H 17/161; E04H 17/163; E04H 17/165; E04H 17/166; E04H 17/17; E04H 17/18; F16B 5/0036; F16B 21/09
See application file for complete search history.

(56) References Cited

U.S. PATENT DOCUMENTS 3,791,096 A * 2/1974 Epperlein ..... E04B 2/74 24/581.1
4,106,630 A * 8/1978 Rosenband ..... A47B 57/22 403/231
5,746,040 A * 5/1998 Young ..... E04H 17/161 52/285.3
7,461,489 B2 * 12/2008 Herbertsson ..... E04H 17/165 256/22
7,516,946 B2 * 4/2009 Fumagalli ..... E04H 17/163 256/28
9,371,642 B2 * 6/2016 Herbertsson ..... E04H 17/163
9,695,613 B2 * 7/2017 Shepherd ..... E04H 17/161
2007/0261333 A1 * 11/2007 Behshid ..... E04H 17/161 52/236.9
2016/0083974 A1 * 3/2016 Meza ..... E04H 17/163 248/219.4
2019/0085590 A1 * 3/2019 Harry ..... E04H 17/143

OTHER PUBLICATIONS

WireCrafters Installation Instructions, Revision 2.4, revised Jul. 26, 2020.
WireCrafters Product Brochure.

* cited by examiner

*Primary Examiner* — Michael P Ferguson
(74) *Attorney, Agent, or Firm* — Stites & Harbison, PLLC; David W. Nagle, Jr.; Gary N. Stewart

(57) ABSTRACT

A panel structure with a slotted mounting system includes: a first post; a second post; and a panel that is configured to be mounted to the first post and the second post. Each post includes one or more fasteners that extend outwardly from a body of the respective posts and can be loosened to define a shelf on which the panel can be hung. The panel includes slots corresponding to and configured to receive the fasteners extending from the body of the first post and the second post. Once hung, the panel is released, and the respective fasteners of the first post and the second post tightened to impose a clamping force to secure the panel. The panel structure can include a plurality of posts with fasteners and a plurality of panels with slots corresponding to the fasteners of the respective posts to provide a multi-walled structure when assembled.

14 Claims, 5 Drawing Sheets

PANEL STRUCTURE WITH SLOTTED MOUNTING SYSTEM

CROSS-REFERENCE TO RELATED APPLICATIONS

The present application claims priority to U.S. Patent Application Ser. No. 63/018,053 filed on Apr. 30, 2020, the entire disclosure of which is incorporated herein by reference.

BACKGROUND OF THE INVENTION

The present invention relates to structures for enclosing or protecting objects, equipment, and/or personnel. In particular, the present invention relates to a structure with a slotted mounting system.

Panel members, such as wire partitions, are commonly used to construct structures for objects, equipment, and/or personnel requiring secured storage, separation, or segregation. Such structures can include, but are not limited to, machine perimeter guarding, robot guards, driver cages, controlled substance drug storage cages, server cages, holding cells, storage lockers, and technical lockers. Assembly of such structures often requires the respective panels of the structure to initially be lifted to a specific position relative to a support, so as to align corresponding openings between the panel and the support, where a suitable fastener can be used to secure the panel member to the support. As such, it is often difficult for a single individual to assemble such structures.

SUMMARY OF THE INVENTION

The present invention is a panel structure with a slotted mounting system that facilitates simple assembly of the panel structure, and which can be implemented to restrict or impede access to an area.

The panel structure includes: a first post; a second post; and a panel that is configured to be mounted to the first post and the second post. The first post and the second post each include one or more fasteners that extend outwardly from a body of the respective posts and can be loosened to define a shelf on which the panel can be hung and tightened to impose a clamping force on the panel once hung. A first side of the panel includes one or more slots corresponding to and configured to receive the one or more fasteners extending outwardly from the body of the first post. A second side of the panel includes one or more slots corresponding to and configured to receive the one or more fasteners extending outwardly from the body of the second post. The panel is thus be hung on the first post and the second post by positioning the panel in a manner which causes the one or more fasteners of the first post to be inserted into corresponding slots defined by the first side of the panel and the one or more fasteners of the second post to be inserted into corresponding slots defined by the second side of the panel. Once hung, the panel is released, and the respective fasteners of the first post and the second post are then tightened to impose a clamping force on the panel that maintains the panel in position relative to the first post and the second post. As the panel can be released to a hanging position on the first post and the second post during assembly of the panel structure, the panel structure of the present application is thus more amenable to assembly by a single individual than panel structures of known construction. When assembled, the panel structure provides a barrier that restricts or impedes access to an area or object.

In some embodiments, each slot defined by the first side or the second side of the panel includes a central portion and at least one channel adjacent to the central portion. In some embodiments, each slot defined by the first side or the second side of the panel includes two channels positioned adjacent to the central portion and opposite of each other. The central portion of each slot permits initial entry of a fastener extending outwardly from the body of either the first post or the second post into the respective slot, and each channel of the slot defines a pathway along which the fastener can move within the slot away from the central portion. In some embodiments, the central portion of each slot defined by the first side or the second side of the panel is defined, at least in part, by a break in an edge of the first side or the second side of the panel. In some embodiments, the first post and the second post each define one or more threaded openings configured to receive and retain a threaded body of a fastener.

In some embodiments, the first post and the second post each include a plate for anchoring the first post and the second post to a ground surface.

In some embodiments, the panel includes a frame and wiring that is welded to and extends from the frame.

In some embodiments, the panel structure can include a plurality of posts, each post including a body with one or more fasteners extending outwardly therefrom, along with a plurality of panels with slots configured to receive respective fasteners extending outwardly from the plurality of posts to provide a multi-walled structure when assembled.

DESCRIPTION OF THE INVENTION

The present invention is a panel structure with a slotted mounting system that facilitates simple assembly of the panel structure, and which can be implemented to restrict or impede access to an area.

Figure 1:
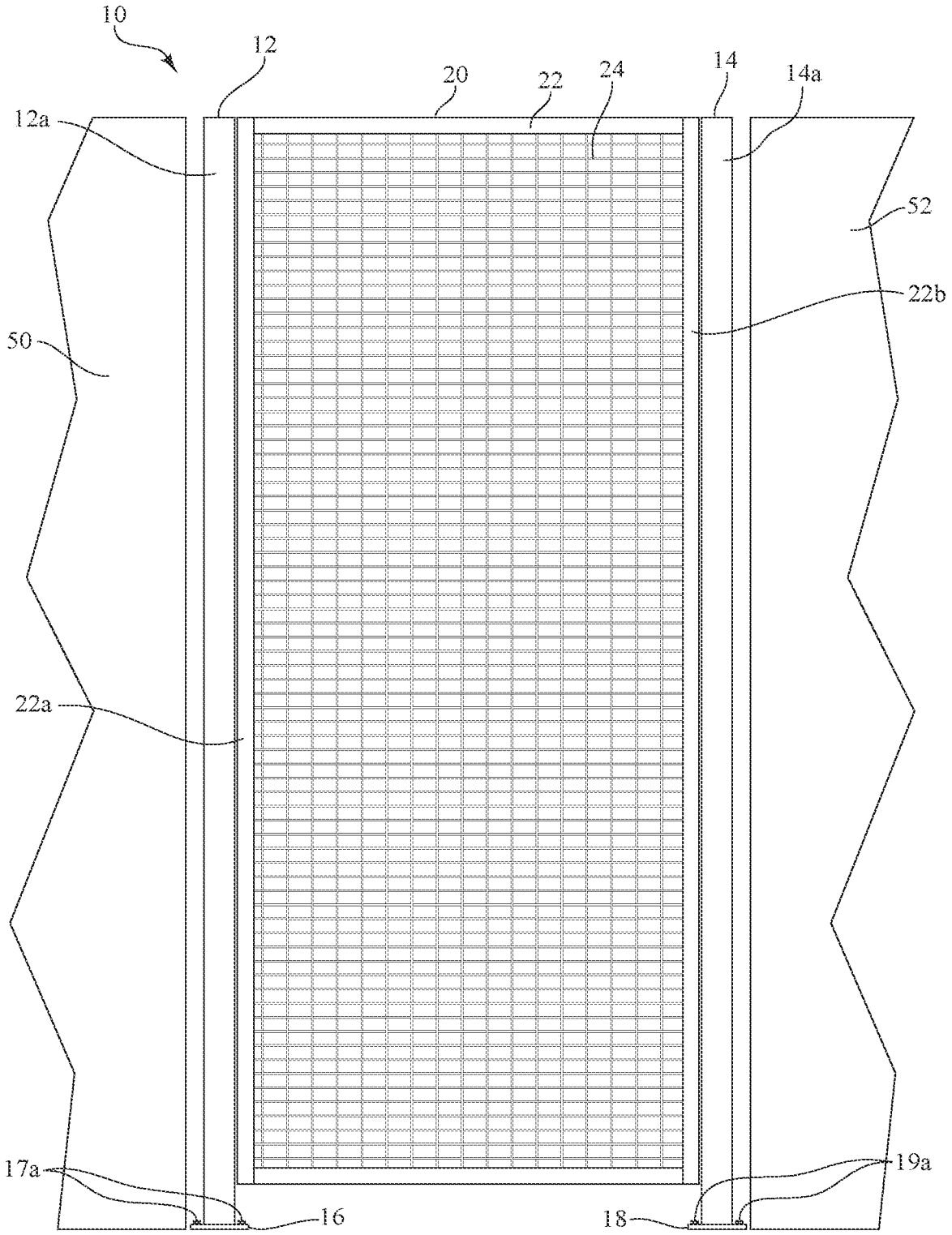
FIG. 1 is a front view of an exemplary panel structure with a slotted mounting system made in accordance with the present invention implemented between two environmental wall structures.

FIG. 1 is a front view of an exemplary panel structure 10 with a slotted mounting system made in accordance with the present invention implemented between two environmental wall structures 50, 52.

Figure 2A:
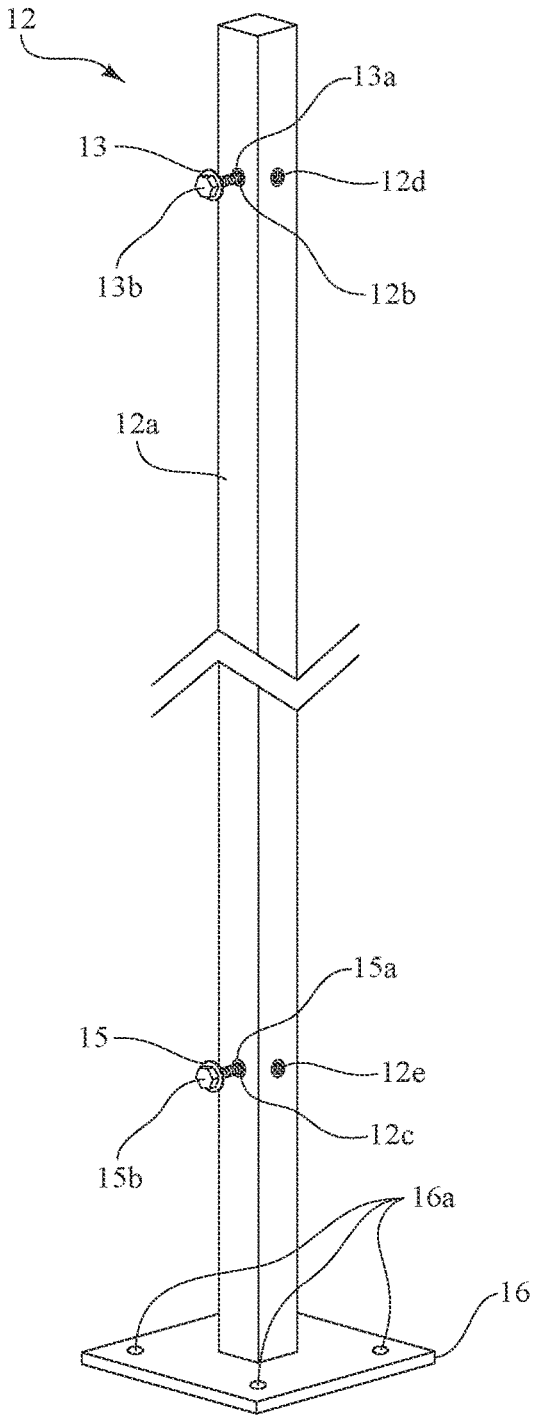
FIG. 2A is a partial view of a first post of the exemplary panel structure of FIG. 1, with the fasteners of the first post in a loosened configuration.
Figure 2B:
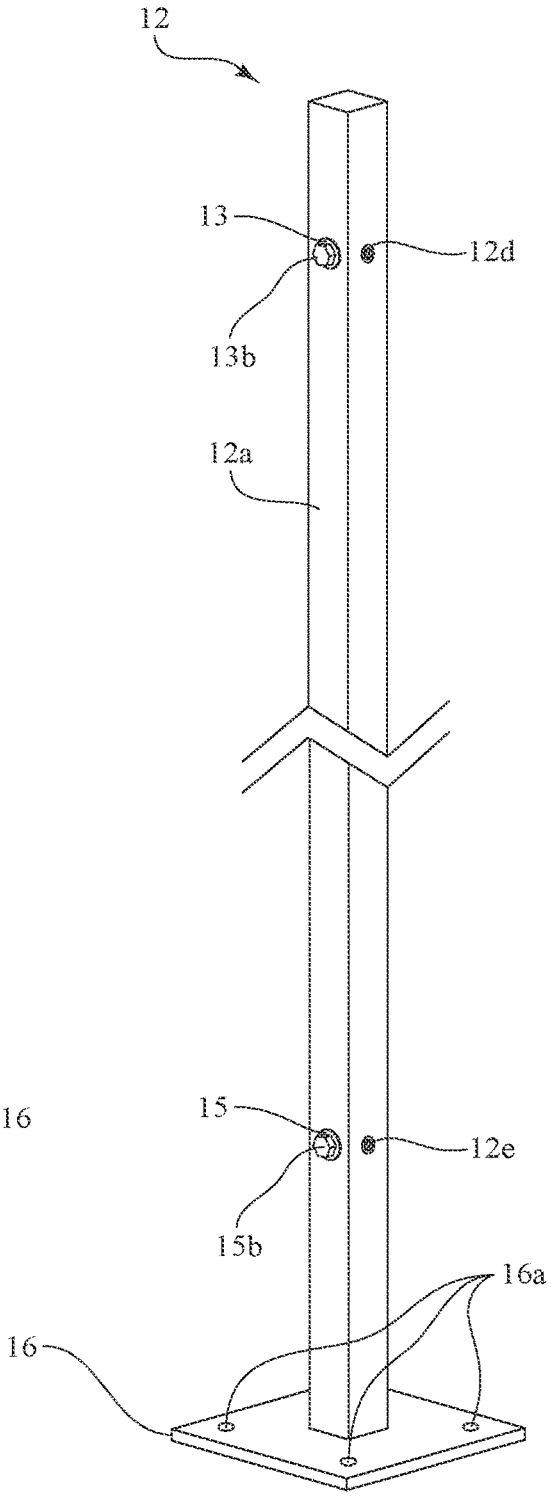
FIG. 2B is another partial view of the first post of the exemplary panel structure of FIG. 1, similar to FIG. 2A, but with the fasteners of the first post in a tightened configuration.

FIGS. 2A-B are partial views of a first post 12 of the structure of FIG. 1, with fasteners 13, 15 of the first post 12 in a loosened configuration and a tightened configuration, respectively.

Figure 3:
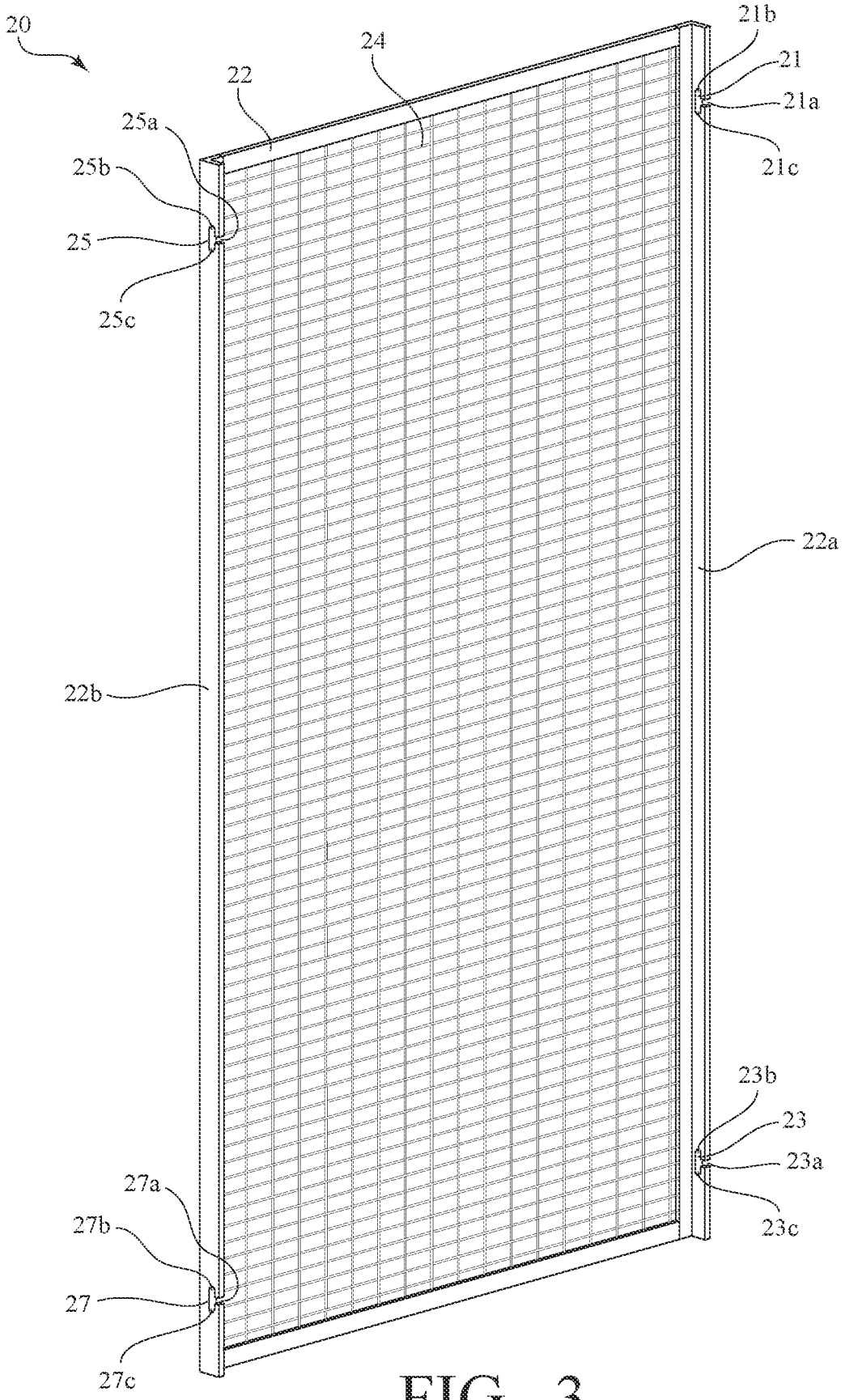
FIG. 3 is a rear perspective view of the panel of the exemplary panel structure of FIG. 1.

FIG. 3 is a rear perspective view of a panel 20 of the structure 10 of FIG. 1.

Figure 4:
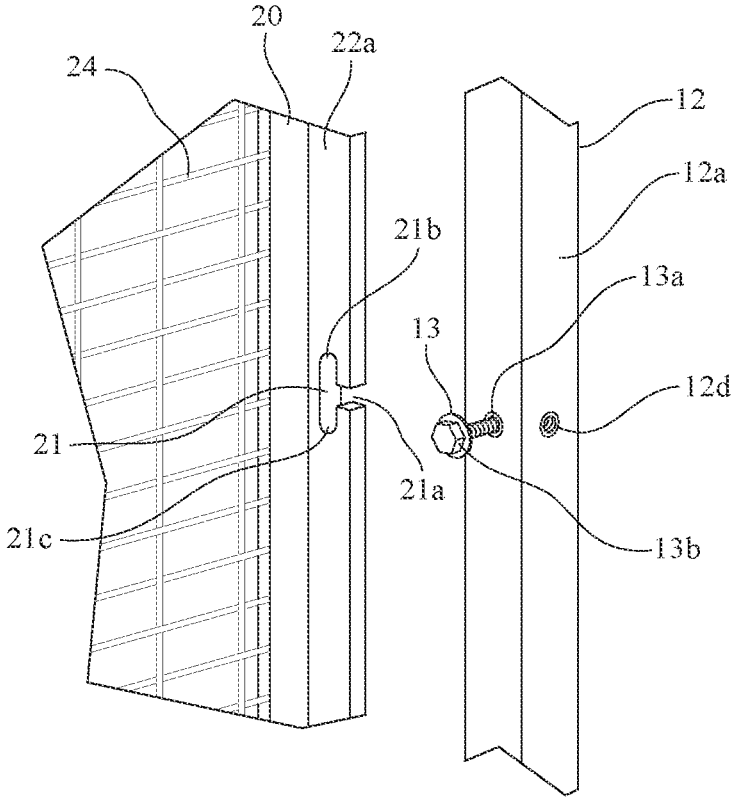
FIG. 4 is a partial view of the exemplary panel structure of FIG. 1, with the panel disassembled from the first post.

FIG. 4 is a partial view of the structure 10 of FIG. 1, with the panel 20 disassembled from the first post 12.

Figure 5:
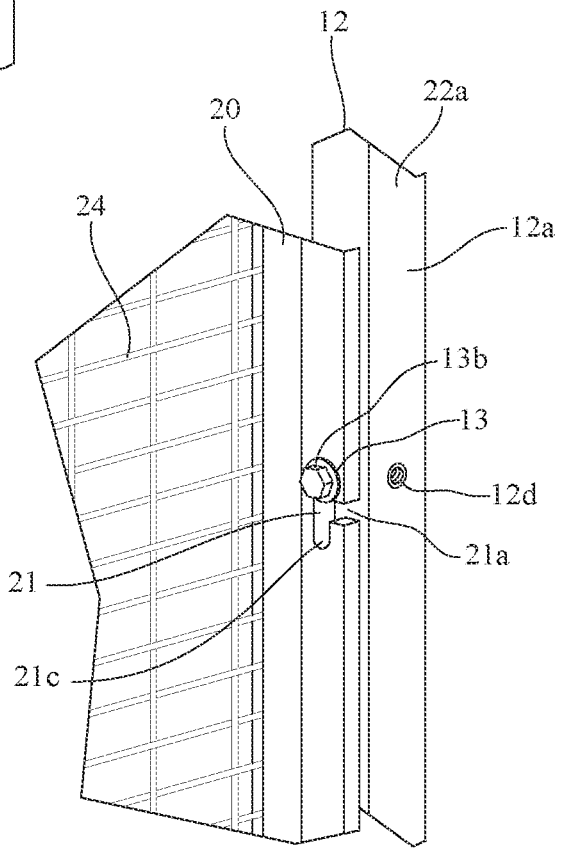
FIG. 5 is another partial view of the exemplary panel structure of FIG. 1 similar to FIG. 4, but with the panel mounted to the first post.

FIG. 5 is another partial view of the structure 10 of FIG. 1 similar to FIG. 4, but with the panel 20 mounted to the first post 12.

Referring now to FIGS. 1, 2A-B, and 3-5, the exemplary panel structure 10 includes: a first post 12; a second post 14; and a panel 20 that is configured to be mounted to the first post 12 and the second post 14. To reduce the amount of labor required to assemble the structure 10, the first post 12, the second post 14, and the panel 20 include components which collectively define a slotted mounting system that facilitates assembly of the structure without the panel 20 having to be lifted and maintained in a specific position while fasteners are inserted in order to mount the panel 20 to the first post 12 and the second post 14. In this regard, the first post 12 and the second post 14 each include one or more fasteners 13, 15 (with the one or more fasteners of the first post 12 being shown in FIGS. 2A-B, 4, and 5) that extend outwardly from a body 12*a*, 14*a* of the respective posts 12, 14 and can be loosened to define a shelf on which the panel 20 can be hung and tightened to impose a clamping force on the panel 20. One side of the panel 20 includes one or more slots 21, 23 that correspond to and are configured to receive the one or more fasteners 13, 15 of the first post 12, and another side of the panel 20 includes one or more slots 25, 27 that correspond to and are configured to receive the one or more fasteners of the second post 14 (not shown).

Referring still to FIGS. 1, 2A-B, and 3-5, the panel 20 is hung on the first post 12 and the second post 14 by positioning the panel 20 in a manner which causes the respective fasteners 13, 15 of the first post 12 to be inserted into the corresponding slots 21, 23 defined by the first side of the panel 20 and the respective fasteners of the second post 14 to be inserted into the corresponding slots 25, 27 defined by the second side of the panel 20. Once hung, the panel 20 is released, and the respective fasteners 13, 15 of the first post 12 and the second post 14 are then tightened to impose a clamping force on the panel 20 that maintains the panel 20 in position relative to the first post 12 and the second post 14. Accordingly, as the panel 20 can be released to a hanging position on the first post 12 and the second post 14, the structure 10 is more amenable to assembly by a single individual than panel member structures of known construction.

Referring now to FIG. 1, in this exemplary embodiment, when assembled, the structure 10 defines a single-walled structure which can be implemented to provide a barrier that restricts or impedes access to a selected area. As shown, in this implementation, the assembled structure 10 is implemented between two environmental wall structures 50, 52 and thus effectively serves as a fence that restricts entry into the channel defined by the two environmental wall structures 50, 52. Of course, it is appreciated that the structure 10 can be implemented within a variety of alternative environments without departing from the spirit or scope of the present invention. Indeed, as described below with reference to FIG. 6, in alternative embodiments, the structure 10 can be implemented in a larger structure that includes additional posts and panels to define a multi-walled structure when assembled.

Referring again to FIGS. 1 and 2A-B, in this exemplary embodiment, the first post 12 and the second post 14 each include a plate 16, 18 at one of its ends. Each plate 16, 18 defines a plurality of openings 16*a*, 18*a* through which bolts or other suitable fasteners 17*a*, 19*a* (shown in FIG. 1) may pass to anchor the respective posts 12, 14 to an underlying ground surface and prevent movement of the structure 10.

Referring now specifically to FIGS. 2A and 2B, in this exemplary embodiment, the first post 12 includes two fasteners: a first fastener 13 extending outwardly from the body 12*a* at one end of the first post 12; and a second fastener 15 extending outwardly from the body 12*a* at another end of the first post 12. The first fastener 13 and the second fastener 15 include a threaded body 13*a*, 15*a* and a head 13*b*, 15*b*. The body 12*a* of the first post 12 defines, and thus can be characterized as including, a first threaded opening 12*b* and a second threaded opening 12*c* in which the threaded body 13*a*, 15*a* of the first fastener 13 and the second fastener 15 are, respectively, retained. As shown by viewing FIGS. 2A and 2B in sequence, the first fastener 13 and the second fastener 15 of the first post 12 are each tightened in a first rotational direction to reduce the extent to which the first fastener 13 and the second fastener 15 extend out of the body 12*a* of the first post 12 and impose a clamping force on the panel 20. Conversely, and as evidenced by viewing FIGS. 2A and 2B in reverse sequence, the first fastener 13 and the second fastener 15 of the first post 12 are loosened in a second rotational direction to increase the extent to which the first fastener 13 and the second fastener 15 extend out of the body 12*a* of the first post 12 and the available area on which the panel 20 can be hung.

Referring still to FIGS. 2A and 2B, in this exemplary embodiment, the first fastener 13 and the second fastener 15 are designed such that the first fastener 13 and the second fastener 15 can be fully removed from the first post 12. In alternative embodiments, however, the first fastener 13 and the second fastener 15 may be retained within the first threaded opening 12*b* and the second threaded opening 12*c*, respectively, such that the first fastener 13 and the second fastener 15 can each be loosened or tightened by rotation, but not fully removed from the threaded opening 12*b*, 12*c* in which it is retained. To this end, in some embodiments, the first fastener 13 and the second fastener 15 can include a distal end (not shown) that has a diameter greater than that exhibited by the threaded opening 12*b*, 12*c* in which it is retained.

Referring now to FIGS. 2A, 2B, and 4, in this exemplary embodiment, the body 12*a* of the first post 12 defines multiple threaded openings 12*b*, 12*c*, 12*d*, 12*e* across its different faces. Specifically, in this embodiment, the body 12*a* of the first post 12 defines, and thus can be characterized as including, a third threaded opening 12*d* and a fourth threaded opening 12*e* defined within a face of the first post 12 that is perpendicular to that of the face defining the first threaded opening 12*b* and the second threaded opening 12*c*. Like the first threaded opening 12*b* and the second threaded opening 12*c*, the third threaded opening 12*d* and the fourth threaded opening 12*e* are also configured to receive a fastener, which can be inserted to enable additional panels to be mounted to the first post 12 or facilitate assembly of the structure 10 in another configuration. It should be appreciated that the number of threaded openings 12*b*, 12*c*, 12*d*, 12*e* and positioning of threaded openings 12*b*, 12*c*, 12*d*, 12*e* defined by the body 12*a* of the first post 12 may be adjusted during manufacture to better accommodate different environments or applications without departing from the spirit or scope of the present application.

Referring now again to FIG. 1, the second post 14 is a mirror image of, but is preferably otherwise identical to, the first post 12. In this regard, although not shown, in this exemplary embodiment, the second post 14 also includes a first fastener and a second fastener that are respectively retained within a first threaded opening and a second threaded opening (not shown) defined by the body 14*a* of the second post 14, such that the first fastener and the second fastener of the second post 14 can be loosened and tightened in the same manner as described above with respect to the first fastener 13 and the second fastener 15 of the first post 12. In this exemplary embodiment, each fastener 13, 15 of the first post 12 and the second post is a threaded bolt. Of course, other suitable fasteners may alternatively be used without departing from the spirit or scope of the present invention.

Referring now to FIGS. 1, 3, 4, and 5, in this exemplary embodiment, the panel 20 of the structure 10 includes a frame 22 and wiring 24 that is welded to and extends from the frame 22 in an overlapping grid (or mesh) pattern. In this exemplary embodiment, the frame 22 is comprised of steel, and the wiring 24 is steel wire welded into a square mesh pattern. Of course, it should be appreciated that the wiring 24 can be arranged in other patterns without departing from the spirit or scope of the present invention. Furthermore, in alternative embodiments, the wiring 24 could be replaced with sheet metal, expanded metal, polycarbonate, or any other suitable material.

Referring now to FIGS. 3-5, in this exemplary embodiment, a first side 22*a* of the frame 22 defines a first slot 21 and a second slot 23 configured to receive the first fastener 13 and the second fastener 15, respectively, extending outwardly from the body 12*a* of the first post 12. Similarly, in this embodiment, a second side 22*b* of the frame 22 defines a first slot 25 and a second slot 27 configured to receive the first fastener and the second fastener, respectively, extending outwardly from the body 14*a* of second post 14. As shown best in FIG. 3, the first slot 21 defined by the first side 22*a* of the frame 22 is positioned opposite of the first slot 25 defined by the second side 22*b* of the frame. Similarly, the second slot 23 defined by the first side 22*a* of the frame 22 is positioned opposite of the second slot 27 defined by the second side 22*b* of the frame 22. As shown, in this exemplary embodiment, both the first side 22*a* of the frame 22 and the second side 22*b* of the frame 22 transversely extend from a plane of the panel 20 corresponding to a portion of the frame 22 to which the wiring 24 is welded.

Referring still to FIGS. 3-5, in this exemplary embodiment, each respective slot 21, 23, 25, 27 defined by the frame 22 can be characterized as including: a central portion 21*a*, 23*a*, 25*a*, 27*a*; a first channel 21*b*, 23*b*, 25*b*, 27*b*; and a second channel 21*c*, 23*c*, 25*c*, 27*c*. The central portion 21*a*, 23*a* of the first slot 21 and the second slot 23 defined in the first side 22*a* of the frame 22 is defined, at least in part, by a break in the edge of the first side 22*a* of the frame 22. Similarly, the central portion 25*a*, 27*a* of the first slot 25 and the second slot 27 defined in the second side 22*b* of the frame 22 is defined, at least in part, by a break in the edge of the second side 22*b* of the frame 22. In each slot 21, 23, 25, 27, the first channel 21*b*, 23*b*, 25*b*, 27*b* is located adjacent to the central portion 21*a*, 23*a*, 25*a*, 27*a*, and the second channel 21*c*, 23*c*, 25*c*, 27*c* is located opposite of the first channel 21*b*, 23*b*, 25*b*, 27*b*. Thus, in this exemplary embodiment, each slot 21, 23, 25, 27 is substantially "T" shaped.

Referring still to FIGS. 3-5, the central portion 21*a*, 23*a*, 25*a*, 27*a* of each slot 21, 23, 25, 27 provides a pathway along which the corresponding fastener 13, 15 of the first post 12 or the second post 14 can initially enter (or subsequently exit) the slot 21, 23, 25, 27. Following insertion of the respective fasteners 13, 15 into the corresponding slots 21, 23, 25, 27 of the first post 12 and the second post 14, the frame 22 can be lowered to a hanging position on top of the fasteners 13, 15 of the first post 12 and the second post 14. The frame 22 is able to be lowered to a hanging position on top of the respective fasteners 13, 15 due to the spacing provided by either the first channel 21*b*, 23*b*, 25*b*, 27*b* or the second channel 21*c*, 23*c*, 25*c*, 27*c* of the respective slots 21, 23, 25, 27, depending on the orientation of the panel 20 relative to the fasteners 13, 15, of the first post 12 and the second post 14.

Due to the shape of the first slots 21, 25 and the second slots 23, 27 defined within the first side 22*a* and the second side 22*b* of the frame 22, respectively, it should be appreciated that the panel 20 can be oriented and mounted to the first post 12 and the second post 14 in an alternative manner from that illustrated within the drawings and described above during construction of the structure 10 and still fall within the spirit and scope of the present invention. For instance, due to the substantially "T" shape of the slots 21, 23, 25, 27, the panel 20 can, in some embodiments, be longitudinally flipped 180° and lowered on to the respective fasteners 13, 15 of the first post 12 and the second post 14, such that the first slot 21 and the second slot 23 defined in the first side 22*a* of the frame 22 corresponds to the second fastener 15 and the first fastener 13, respectively, of the first post 12 and the first slot 25 and the second slot 27 of the second side 22*b* of the frame 22 corresponds to the second fastener and the first fastener, respectively, of the second post 14. Furthermore, as a result of the first slot 21 and the second slot 23 defined by the first side 22*a* of the frame 22 being positioned opposite of each other, and the first slot 25 and the second slot 27 defined by the second side 22*b* of the frame 22 being positioned opposite of each other, the panel 20 can, in other embodiments, be laterally flipped 180° horizontally and lowered on to the respective fasteners 13, 15 of the first post 12 and the second post 14, such that the first slot 21 and the second slot 23 defined in the first side 22*a* of the frame correspond to the first fastener and the second fastener of the second post 14 and the first slot 25 and the second slot 27 defined in the second side 22*b* of the frame 22 correspond to the first fastener 13 and the second fastener 15 of the first post 12.

Although each post 12, 14 of the structure 10 is generally described herein as including multiple fasteners 13, 15, and the first side 22*a* and the second side 22*b* of the frame 22 is generally described as including multiple slots 21, 23, 25, 27, alternative embodiments are contemplated in which each post 12, 14 includes only a single fastener and the first side 22*a* and the second side 22*b* of the frame 22 each include only a single slot.

Referring now to FIGS. 1, 2A, and 4, to facilitate hanging of the panel 20 on the fasteners 13, 15 of the first post 12 and the second post 14, it is generally preferred that the first post 12, and the second post 14 are first anchored to a ground surface in an upright position, as shown in FIG. 1. Further, to this end, it is generally preferred that the fasteners 13, 15 of the first post 12 and the fasteners of the second post 14 be loosened to provide a shelf of suitable length for the frame 22 of the panel 20 to rest on, as shown in FIGS. 2A and 4. Once the frame 22 is lowered to the hanging position on top of the respective fasteners 13, 15 the weight of the panel 20 is effectively carried by the structure 10, and, more specifically, by the first post 12 and the second post 14. As such, once the panel 20 is hung, it is no longer necessary for the individual assembling the structure 10 to maintain the panel 20 in a raised position.

As perhaps shown best by viewing FIGS. 4 and 5 in sequence, after the frame 22 is lowered to the hanging position on the respective fasteners 13, 15 of the first post 12 and the second post 14, the respective fasteners 13, 15 of the first post 12 and the second post 14 are rotated in the first rotational direction to tighten the fasteners 13, 15 and secure the panel 20 in a fixed position between the first post 12 and the second post 14. The head 13*b*, 15*b* of each fastener 13, 15 is preferably sized to have a diameter greater than that of each of the first channel 21*b*, 23*b*, 25*b*, 27*b*, and the second channel 21*c*, 23*c*, 25*c*, 27*c* of the slot 21, 23, 25, 27 to which it corresponds to prevent the respective fastener 13, 15 from passing entirely through the slot 21, 23, 25, 27. As the first fastener 13 and the second fastener 15 of the first post 12 are tightened, a clamping force is applied to the first side 22*a* of the frame 22 due to the convergence of the body 12*a* of the first post 12 and the heads 13*b*, 15*b* of the first fastener 13 and the second fastener 15. Similarly, as the first fastener and the second fastener of the second post 14 are tightened, a clamping force is applied to the second side 22*b* of the frame 22 due to the convergence of the body 14*a* of the second post 14 and the heads of the first fastener and the second fastener of the second post 14.

Figure 6:
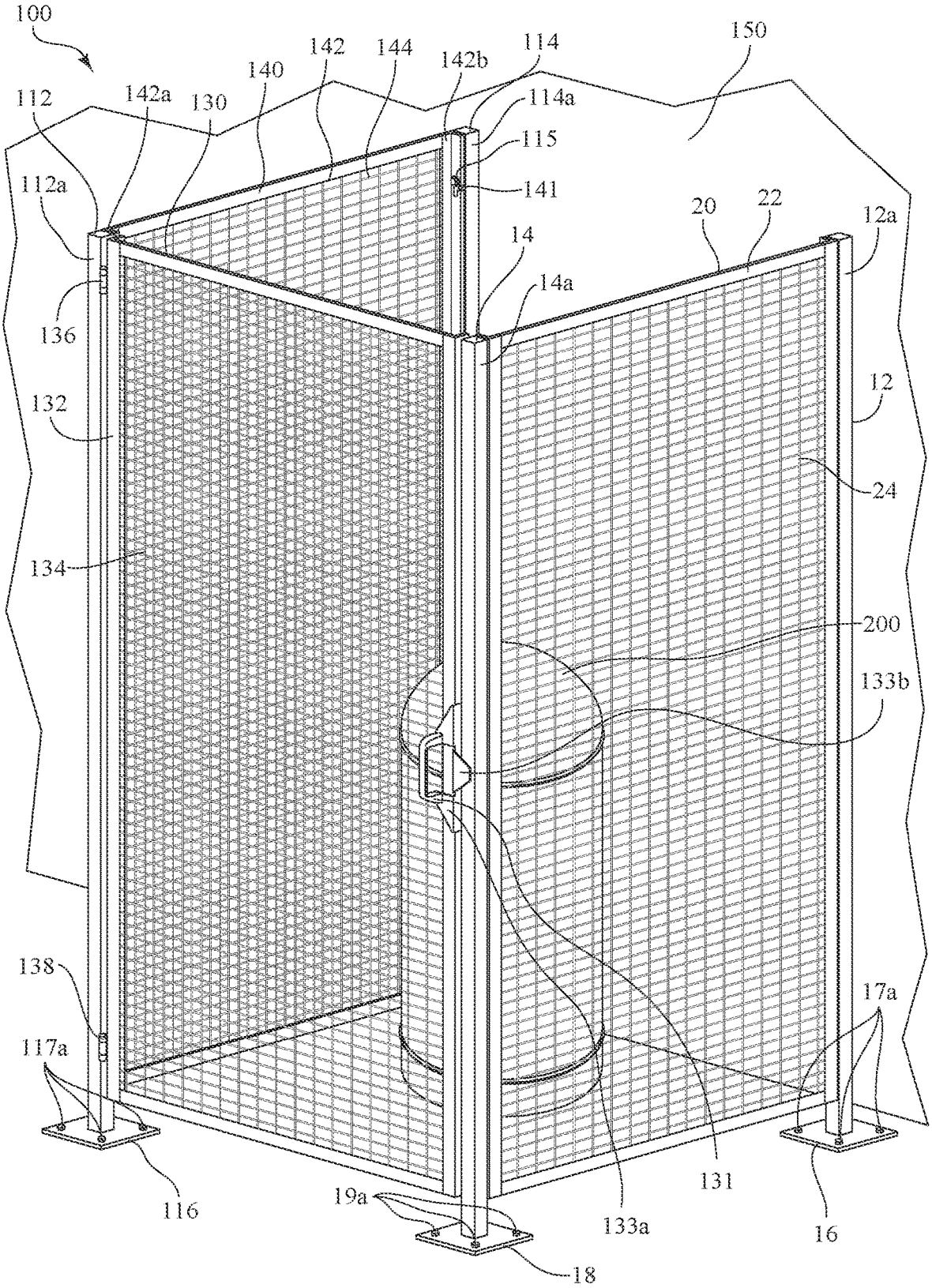
FIG. 6 is a perspective view of another exemplary panel structure with a slotted mounting system made in accordance with the present invention.

FIG. 6 is a perspective view of another exemplary panel structure with a slotted mounting system 100 (or structure 100) made in accordance with the present invention.

As shown in FIG. 6, in this exemplary embodiment, the structure 100 includes a plurality of posts 12, 14, 112, 114 and a plurality of panels 20, 130, 140, with each panel 20, 130, 140 mounted to at least one of the posts 12, 14, 112, 114. Specifically, in this exemplary embodiment, the structure 100 includes four posts 12, 14, 112, 114: a first post 12; a second post 14; a third post 112; and a fourth post 114. Furthermore, in this exemplary embodiment, the structure includes three panels 20, 130, 140: a first panel 20 mounted to and extending between the first post 12 and the second post 14; a second panel 130 mounted to the third post 112; and a third panel 140 mounted to and extending between the third post 112 and the fourth post 114. The first post 12, the second post 14, and the first panel 20 are structurally identical and assembled together in the same manner as that of the structure 10 described above with reference to FIGS. 1, 2A-B, and 3-5. In this regard, the structure 100 in this exemplary embodiment thus includes and builds upon the structure 10 described above with reference to FIGS. 1, 2A-B, and 3-5 to provide a multi-walled structure. Like reference numerals are provided with like components throughout the present disclosure.

Referring still to FIG. 6, the third post 112 and the fourth post 114 of the structure 100 are structurally identical to the first post 12 and the second post 14. In this regard, like the first post 12 and the second post 14, the third post 112 and the fourth post 114 thus each include a first fastener and a second fastener (though only the first fastener 115 of the fourth post 114 is visible in FIG. 6) retained by corresponding threaded openings (not shown) defined in a body 112*a*, 114*a*, of the third post 112 and the fourth post 114. Like the first fasteners 13 and the second fasteners 15 of the first post 12 and the second post 14, the first fasteners 115 and the second fasteners of the third post 112 and the fourth post 114 can also be loosened to provide a shelf on which the third panel 140 can be hung and tightened to impose a clamping force on the third panel 140 once hung. As shown, the third post 112 and the fourth post 114 also include a plate 116 at one of its ends (though only the plate 116 corresponding to the third post 112 is visible in FIG. 6), with each plate 116, 118 defining a plurality of openings through which bolts or other suitable fasteners 117*a* may pass to anchor the respective posts 112, 114 to an underlying ground surface.

Referring still to FIG. 6, the third panel 140 is structurally identical to the first panel 20, and, in this regard, includes a frame 142 and wiring 144 that is welded to and extends from the frame 142 in an overlapping grid (or mesh) pattern. A first side 142*a* of the frame 142 of the third panel 140 defines a first slot and a second slot (not shown) configured to receive the fasteners, respectively, extending outwardly from the body 112*a* of the third post 112. A second side 142*b* of the frame 142 of the third panel 140 similarly defines a first slot 141 and a second slot (not shown) configured to receive the first fastener 115 and the second fastener, respectively, of the fourth post 114. As shown, in this implementation, the fourth post 114, the third post 112, the third panel 140 are assembled and positioned as to be a mirror image of the first post 12, the second post 14, and the first panel 20, respectively.

Referring still to FIG. 6, the second panel 130 also includes a frame 132 and wiring 134 that is welded to and extends from the frame 132 in an overlapping grid (or mesh) pattern. In this exemplary embodiment, the second panel 130 defines a door which can be transitioned between a closed position and an open position. In this embodiment, the second panel 130 defines a hinged door, which is mounted for rotation with respect to the third post 112 via one or more hinges 136, 138. In this particular embodiment, the second panel 130 is mounted for rotation using a first hinge 136 and a second hinge 138. The second panel 130 further includes a handle 131 and a first portion of a latching and/or locking mechanism 133*a*. The first portion of the latching and/or locking mechanism is configured to engage with a second portion of the latching and/or locking mechanism 133*b* positioned opposite of the post to which the second panel 130 is mounted, which, in this case, is the second post 14. In this exemplary embodiment, the first portion of the latching and/or locking mechanism 133*a* and the second portion the latching and/or locking mechanism 133*b* collectively define a latch or lock configured to unlock when activated by a key, card reader, key pad, or push button. It is appreciated, however, that the latching/locking mechanism may comprise a variety of mechanical locks (e.g., thumb-turn latches, door knobs, interior key locks, etc.), a variety of electrical inter-locking devices (e.g., proximity readers, keypads, electro-magnetic locking mechanism, etc.), or combinations thereof without departing from the spirit or scope of the present invention.

Referring still to FIG. 6, when assembled and the second panel 130 is in the closed position, the structure 100 defines a three-walled structure that can be implemented to restrict access to an object 200 or area. As shown, in this implementation, the structure 100 is positioned as to abut an environmental wall structure 150 and to enclose and restrict access to an object 200 when the structure 100 is assembled. Of course, it is appreciated that the posts 12, 14, 112, 114 and/or panels 20, 130, 140 of the structure 100 may be adapted and implemented to accommodate a variety of applications and environments, and, as such, include additional or fewer posts and/or panels.

One of ordinary skill in the art will recognize that additional embodiments and implementations are also possible without departing from the teachings of the present invention. This detailed description, and particularly the specific details of the exemplary embodiments disclosed herein, are given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A panel structure with a slotted mounting system, comprising:

a first post, including a body and one or more threaded fasteners extending outwardly from the body of the first post;

a second post, including a body and one or more threaded fasteners extending outwardly from the body of the second post; and a panel, the panel including a first side defining one or more slots configured to receive a fastener of the one or more fasteners extending outwardly from the body of the first post and a second side defining one or more slots configured to receive a fastener of the one or more fasteners extending outwardly from the body of the second post;

wherein the one or more fasteners extending outwardly from the body of the first post and the one or more fasteners extending outwardly from the body of the second post are each configured to be loosened to define a shelf on which the panel can be hung, and then tightened to impose a clamping force on the panel once hung on the shelf;

wherein the first and second sides of the panel transversely extend from a plane of the panel;

wherein each slot defined by the panel includes (i) a central portion that is defined, at least in part, by a break in an edge of the first side of the panel or the second side of the panel, and is configured to permit entry of a respective fastener of the one or more fasteners extending outwardly from the body of the first post or the second post into the slot, (ii) a first channel adjacent to a distal end of the central portion, the first channel defining a first pathway along which the respective fastener of the one or more fasteners extending outwardly from the body of the first post or the second post can move within the slot away from the central portion, and (iii) a second channel adjacent to the distal end of the central portion and opposite of the first channel, the second channel defining a second pathway along which the respective fastener of the one or more fasteners extending outwardly from the body of the first post or the second post can move within the slot away from the central portion;

wherein the central portion of each slot is horizontally oriented when the panel is in an upright position; and wherein the first channel and the second channel of each slot is vertically oriented relative to the central portion of the slot when the panel is in the upright position.

2. The panel structure as recited in claim 1, wherein the one or more fasteners extending outwardly from the body of the first post includes a threaded body and the first post defines one or more threaded openings, and wherein each threaded opening of the one or more threaded openings defined by the first post corresponds to and retains a fastener of the one or more fasteners extending outwardly from the body of the first post.

3. The panel structure as recited in claim 1, wherein the panel includes a frame and wiring that is welded to and extends from the frame.

4. The panel structure as recited in claim 1, wherein a distal end of the first post includes a first plate for anchoring the first post to a ground surface, and a distal end of the second post includes a second plate for anchoring the second post to the ground surface.

5. The panel structure as recited in claim 1, wherein the first side and the second side of the panel are defined by a frame of the panel, and wherein the frame defines a perimeter of the panel.

6. A panel structure with a slotted mounting system, comprising:

a first post, including a body and one or more fasteners extending outwardly from the body of the first post, the one or more fasteners extending outwardly from the body of the first post each including a threaded body, and the first post defining one or more threaded openings in which the threaded body of a respective fastener of the one or more fasteners extending outwardly from the body of the first post is retained;

a second post, including a body and one or more fasteners extending outwardly from the body of the second post, the one or more fasteners extending outwardly from the second post each including a threaded body, and the second post defining one or more threaded openings in which the threaded body of a respective fastener of the one or more fasteners extending outwardly from the body of the second post is retained; and a panel, the panel including a first side defining one or more slots configured to receive a respective fastener of the one or more fasteners extending outwardly from the body of the first post and a second side defining one or more slots configured to receive a respective fastener of the one or more fasteners extending outwardly from the body of the second post;

wherein the first and second sides of the panel transversely extend from a plane of the panel;

wherein each slot defined by the panel includes (i) a central portion that is defined, at least in part, by a break in an edge of the first side of the panel or the second side of the panel, and is configured to permit entry of a respective fastener of the one or more fasteners extending outwardly from the body of the first post or a respective fastener of the one or more fasteners extending outwardly from the second post into the slot, (ii) a first channel adjacent to a distal end of the central portion, the first channel defining a first pathway along which the respective fastener of the one or more fasteners extending outwardly from the body of the first post or the second post can move within the slot away from the central portion, and (iii) a second channel adjacent to the distal end of the central portion and opposite of the first channel, the second channel defining a second pathway along which the respective fastener of the one or more fasteners extending outwardly from the body of the first post or the second post can move within the slot away from the central portion; and wherein the one or more fasteners extending outwardly from the body of the first post and the one or more fasteners extending outwardly from the second post are configured to be loosened to define a shelf on which the panel can be hung, and then tightened to impose a clamping force on the panel once hung on the shelf.

7. The panel structure as recited in claim 6, wherein the first side and the second side of the panel are defined by a frame of the panel, and wherein the frame defines a perimeter of the panel.

8. The panel structure as recited in claim 6, wherein the central portion of each slot is horizontally oriented when the panel is in an upright position; and wherein the first channel and the second channel of each slot is vertically oriented relative to the central portion of the slot when the panel is in the upright position.

9. A panel structure with a slotted mounting system, comprising:

a plurality of posts, with each post of the plurality of posts including a body and one or more threaded fasteners extending outwardly from the body; and a plurality of panels, each panel of the plurality of panels including a frame and a wiring that is welded to and extends from the frame, with each panel of the plurality of panels mounted to at least one post of the plurality of posts;

wherein opposing sides of a frame of a first panel of the plurality of panels are mounted to respective posts of a first pair of posts of the plurality of posts via a fastener connection, with each side of the opposing sides of the frame of the first panel defining one or more slots configured to receive a fastener of the one or more fasteners extending outwardly from a post of the first pair of posts;

wherein the opposing sides of the frame of the first panel transversely extend from a plane of the first panel; and wherein each slot defined by the first panel includes (i) a central portion defined, at least in part, by a break in an edge of one of the opposing sides of the first panel, and is configured to permit entry of a respective fastener of the one or more fasteners extending outwardly from one of the plurality of posts into the slot, (ii) a first channel adjacent to a distal end of the central portion, the first channel defining a first pathway along which the respective fastener of the one of the plurality of posts can move within the slot away from the central portion, and (iii) a second channel adjacent to the distal end of the central portion and opposite of the first channel, the second channel defining a second pathway along which the respective fastener of the one of the plurality of posts can move within the slot away from the central portion.

10. The panel structure as recited in claim 9, wherein each fastener corresponding to the one or more slots defined on each side of the opposing sides of the frame of the first panel is configured to be loosened to define a shelf on which the frame of the first panel can be hung, and then tightened to impose a clamping force on the frame of the first panel once hung on the shelf.

11. The panel structure as recited in claim 9, wherein each fastener corresponding to the one or more slots defined on each side of the opposing sides of the first panel is retained by a post of the first pair of posts.

12. The panel structure as recited in claim 9, wherein opposing sides of a frame of a second panel of the plurality of panels are mounted to respective posts of a second pair of posts of the plurality of posts via a fastener connection, with each side of the opposing sides of the frame of the second panel defining one or more slots configured to receive a fastener of the one or more fasteners extending outwardly from a post of the second pair of posts, and wherein the frame of the second panel defines a perimeter of the second panel.

13. The panel structure as recited in claim 9, wherein the frame of the first panel defines a perimeter of the first panel.

14. The panel structure as recited in claim 9, wherein the central portion of each slot is horizontally oriented when the panel is in an upright position; and wherein the first channel and the second channel of each slot is vertically oriented relative to the central portion of the slot when the panel is in the upright position.

* * * * *